US010352067B2

(12) United States Patent
Cahill et al.

(10) Patent No.: US 10,352,067 B2
(45) Date of Patent: Jul. 16, 2019

(54) KEY MONITORING DOOR LOCK, DOOR LOCK KEY MONITORING SYSTEM, AND METHOD THEREOF

(71) Applicant: Proxess, LLC, Littleton, CO (US)

(72) Inventors: Jeffrey S. Cahill, Castle Rock, CO (US); Jon P. Torre, Littleton, CO (US)

(73) Assignee: Proxess, LLC, Littleton, CO (US)

( * ) Notice: Subject to any disclaimer, the term of this patent is extended or adjusted under 35 U.S.C. 154(b) by 51 days.

(21) Appl. No.: 15/788,447

(22) Filed: Oct. 19, 2017

(65) Prior Publication Data

US 2018/0106073 A1 Apr. 19, 2018

Related U.S. Application Data

(60) Provisional application No. 62/410,205, filed on Oct. 19, 2016.

(51) Int. Cl.

| | |
|---|---|
| ***E05B 39/00*** | (2006.01) |
| ***E05B 39/04*** | (2006.01) |
| ***E05B 17/22*** | (2006.01) |
| ***G07C 9/00*** | (2006.01) |
| ***E05B 47/06*** | (2006.01) |
| *E05B 47/00* | (2006.01) |

(52) U.S. Cl.

CPC ..... *E05B 39/04* (2013.01); *E05B 17/22* (2013.01); *E05B 39/00* (2013.01); *E05B 47/0611* (2013.01); *G07C 9/00007* (2013.01); *G07C 9/00174* (2013.01); *E05B 47/0001* (2013.01); *E05B 47/0012* (2013.01); *E05B 2047/0067* (2013.01); *E05B 2047/0084* (2013.01); *E05B 2047/0086* (2013.01)

(58) Field of Classification Search

CPC ..... E05B 39/04; E05B 17/22; E05B 47/0001; E05B 2047/0067; E05B 2047/0084; E05B 39/00; E05B 47/0012; E05B 47/0061; E05B 2047/0086; G07C 9/00007; G07C 9/00174

USPC ..... 70/277, 278.1–278.3; 340/5.64, 5.7

See application file for complete search history.

(56) References Cited

U.S. PATENT DOCUMENTS

| | | | | | |
|---|---|---|---|---|---|
| 5,083,122 | A * | 1/1992 | Clark | E05B 47/0012 | 340/5.22 |
| 5,782,118 | A * | 7/1998 | Chamberlain | E05B 47/0012 | 70/277 |
| 5,933,086 | A * | 8/1999 | Tischendorf | E05B 47/0661 | 340/12.22 |
| 6,147,622 | A * | 11/2000 | Fonea | E05B 47/0642 | 235/380 |
| 6,967,562 | B2 * | 11/2005 | Menard | E05B 45/06 | 292/346 |
| 8,356,499 | B2 * | 1/2013 | Peng | E05B 47/068 | 70/224 |
| 8,690,205 | B2 * | 4/2014 | Benitez | E05B 17/22 | 292/347 |
| 9,181,730 | B1 * | 11/2015 | Peng | E05B 47/0012 | |
| 9,273,489 | B2 * | 3/2016 | Hickman | E05B 47/0012 | |
| 9,316,022 | B2 * | 4/2016 | Tyner | E05B 17/00 | |

(Continued)

*Primary Examiner* — Suzanne L Barrett

(74) *Attorney, Agent, or Firm* — Holzer Patel Drennan

(57) ABSTRACT

An electronic lockset mounted on a door, the electronic lock including a lock to prevent the door from opening when in a locked state, a handle to open the door when the lock is in an unlocked state, a sensor to sense whether a non-electronic key has attempted to open the lock, and a printed circuit board to store information sensed by the sensor.

17 Claims, 11 Drawing Sheets

(56) References Cited

U.S. PATENT DOCUMENTS

| | | | | |
|---|---|---|---|---|
| 9,512,644 | B2 * | 12/2016 | Lambrou | E05B 47/0012 |
| 9,512,645 | B2 * | 12/2016 | Lowder | E05B 17/22 |
| 9,530,262 | B2 * | 12/2016 | Johnson | H04W 4/80 |
| 9,574,372 | B2 * | 2/2017 | Johnson | E05B 1/0007 |
| 9,916,746 | B2 * | 3/2018 | Johnson | G08B 13/19695 |
| 9,922,481 | B2 * | 3/2018 | Johnson | G07C 9/00571 |
| 2011/0203331 | A1 * | 8/2011 | Picard | E05B 9/02 70/91 |
| 2012/0192602 | A1 * | 8/2012 | Bacon | E05B 13/10 70/278.1 |
| 2017/0342740 | A1 * | 11/2017 | Basavaraju | E05B 17/10 |
| 2018/0106073 | A1 * | 4/2018 | Cahill | E05B 39/04 |

* cited by examiner

KEY MONITORING DOOR LOCK, DOOR LOCK KEY MONITORING SYSTEM, AND METHOD THEREOF

CROSS-REFERENCE TO RELATED APPLICATIONS

This application claims priority under 35 USC § 120 from U.S. Provisional Application No. 62/410,205, filed on Oct. 19, 2016, in the United Stated Patent and Trademark Office, the disclosure of which is incorporated herein in its entirety by reference.

BACKGROUND

1. Field

The present general inventive concept relates to an electronic door lock, and more particularly to an electronic door lock that detects whether a physical non-electric key has been used to open the electronic door lock, and method thereof.

2. Description of the Related Art

Conventional electronic locks allow a user to use digital keys, such as dongles (e.g., key fobs), cards, chip-cards, mobile devices, keypads, touch plates, cameras, and other types of wireless communication objects and/or devices in order to lock and/or unlock the conventional electronic locks. In other words, the conventional electronic locks may include card readers, chip readers, sensors, keypads, and other types of wireless devices that interact with the digital keys in order to open the conventional electronic locks.

When the user uses a personal chip-card, for example, to unlock the conventional electronic lock, credentials of the user are typically programmed on the chip-card so that the conventional electronic lock can determine whether the user is authorized to unlock the conventional electronic lock. As such, if the credentials of the user do not match an authorized user list, which is typically stored in a server or database, the user cannot unlock the conventional electronic lock. Also, the conventional electronic lock may send information to the server or an administrator regarding the user's attempt to open the conventional electronic lock.

However, if the user attempts to open the conventional electronic lock using a regular key (i.e., a standard non-electronic key or external key) that inserts into a pin-and-tumbler (or similar non-electronic) lock attached to the conventional electronic lock, for example, the conventional electronic lock has no way of monitoring that the conventional electronic lock has been opened. Also, the conventional electronic lock has no way of monitoring who attempted to access the conventional electronic lock when the user uses a regular key. Therefore, if the electronic lock system fails due to an emergency or power outage, there is no way to track if and/or when the lock was opened by a standard non-electronic key.

Therefore, there is a need to monitor if and/or when an electronic lock has been opened by a standard non-electronic key.

SUMMARY

The present general inventive concept provides a device and method of detecting whether a non-electronic key has been utilized to open a door lock.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an electronic lockset mounted on a door, the electronic lock including a lock to prevent the door from opening when the lock is in a locked state, a handle to open the door when the lock is in an unlocked state, a sensor to sense whether a non-electronic key has attempted to open the lock, and a printed circuit board (PCB) to store information sensed by the sensor.

The lock may include an outside handle connected assembly connected to the handle, a latch bolt to be at least partially disposed within a door strike when the door is shut, a latch-connecting mechanism connected at a first end to the latch bolt and connected at a second end to at least a portion of the outside handle connected assembly, to move from a first position to a second position in response to a turning of the handle.

The sensor may include a switch including a switching portion to move from a first switch position to a second switch position in response to the latch-connecting mechanism contacting and pushing the switching portion during movement of the latch-connecting mechanism from the first position to the second position.

The PCB may detect that the switching portion has moved from the first position to the second position and interprets the movement of the switching portion as an indication that the non-electronic key has opened the lock.

The electronic lockset may further include a rotating portion to rotate simultaneously with a rotation of the handle, the rotating portion comprising a switch contact portion to rotate together with the rotating portion, wherein the sensor comprises a handle switch switching portion to move from a first handle switch position to a second handle switch position in response to the switch contact portion of the rotating portion contacting and pushing the handle switch switching portion.

The PCB may detect that the handle switch switching portion has moved from the first handle switch position to the second handle switch position and interprets the movement of the handle switch switching portion as an indication that the non-electronic key has opened the lock.

The lock may include a cylinder to receive the non-electronic key therein, and a throw member to rotate along with and in response to a rotation of the non-electronic key within the cylinder.

The sensor may include an accelerometer assembly, including an accelerometer to detect whether the throw member has been rotated, and another printed circuit board to send a signal to the PCB that the accelerometer has been rotated to indicate that the non-electronic lock has opened the lock.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Various example embodiments will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like or similar elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
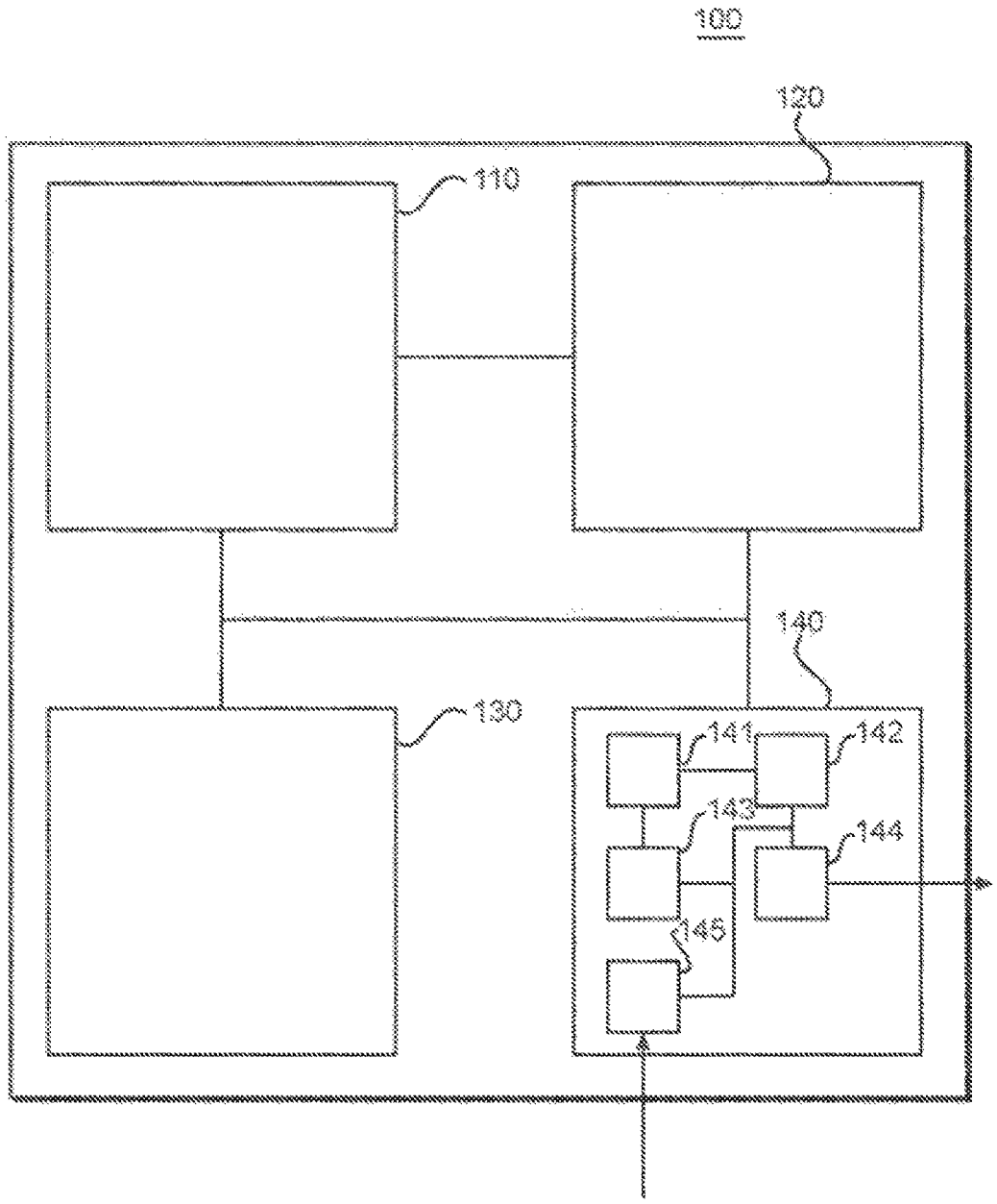
FIG. 1 illustrates a block diagram of a lockset, according to an exemplary embodiment of the present general inventive concept.

FIG. 1 illustrates a block diagram of a lockset 100, according to an exemplary embodiment of the present general inventive concept.

The lockset 100 may be an electronic lockset, an online lockset, and an offline lockset, but is not limited thereto. Also, the lockset 100 may be a combined lock and handle set, or may include the lock portion separately from the handle portion. The lockset 100 may be mounted on a door, but is not limited thereto.

The lockset 100 may include a lock 110, a handle 120, a sensor 130, and a printed circuit board (PCB) 140, but is not limited thereto.

The lock 110 may be at least one of a knob lock, a lever handle lock, a deadbolt lock, a mortise lock, and keyless entry lock, but is not limited thereto. The lock may be unlocked by an electronic key, such as a key card, chip card, fob, etc., or may alternatively be unlocked by a regular, non-electronic, key. Furthermore, other mechanisms may be used to lock and/or unlock the lock 110, such as mobile devices, keypads, touch plates, cameras, and other types of wireless communication objects and/or devices.

The handle 120 may be at least one of a lever, a handle, a push plate, and a door pull, but is not limited thereto. When the lock 110 is in an unlocked state, then a user may use the handle 120 to open the door. When the lock 110 is in a locked state, then the user needs to first use a key to open the lock 110 before the door can be opened.

The sensor 130 may be at least one of a pressure sensor, a force sensor, a density sensor, a level sensor, a proximity sensor, a tilt sensor, a presence sensor, a position sensor, an angle sensor, a displacement sensor, a distance sensor, a speed sensor, an acceleration sensor, an optical sensor, a light sensor, an imaging sensor, an electric current sensor, an electric potential sensor, a magnetic sensor, an acoustic sensor, a sound sensor, and a vibration sensor, but is not limited thereto.

The sensor 130 may be provided in plurality, and may include various combinations of the above sensor-types. For example, a tilt sensor may sense whether an interior handle has been turned by monitoring the inner door handle, or whether a throw member within the lock has been turned.

Alternatively, a pressure sensor, such as a switch, can be triggered when a latch is opened inside the lock, by having a portion of the latch touch and move the switch to a different position.

The PCB 140 may include a storage unit 141, a processor 142, a controller 143, a transceiver 144, and a receiver 145, but is not limited thereto. Furthermore, the PCB 140 may include the sensor 130 as an integrated component of the PCB 140, or alternatively, may be provided separately from the PCB 140 and connected via a wire or wirelessly, thereto.

The storage unit 141 may include a memory storage device that stores information received from the sensor 130. More specifically, in response to the sensor 130 sensing that a key has been used in the lock 110 or that the handle 120 has been turned, the storage unit 141 may store information related to whether the a key has been used in the lock 110 or that the handle 120 has been turned, based on a particular embodiment of the present general inventive concept.

The processor 142 may include logic that determines at least one of, or a combination of, whether an electronic credential from a key card has activated the unlocking mechanism, whether the interior door handle has been turned, and whether the latch is currently retracted. If the electronic credential from a key card has not activated the unlocking mechanism, the interior door handle has not been turned, and the latch is currently retracted, or any combination of the above, then the processor 142 determines that an external key must have been used to engage the latch.

The processor 142 may alternatively include logic that determines at least one of, or a combination of, whether an external key has been inserted into the lock, whether the exterior door handle has been turned, and whether the latch has moved. If the external key has been inserted into the lock, the handle has been turned, and the latch has moved, or any combination of the above, then the processor 142 determines that an external key must have been used to engage the latch.

The controller 143 may control the RF transceiver 144 to send a notification to an external access control system (not illustrated) to notify an administrator that the door has been accessed by a physical non-electronic key.

The RF transceiver 144 may send information stored in the storage unit 141 to an external device, such as a mobile device, upon request from a user. As such, a user can receive information regarding whether a physical non-electronic key has been used to open the lock, even if the lock is offline and/or not accessible remotely.

The RF receiver 145 may receive credential information when a card key is used, such that credential information and other information regarding access times can be stored in the storage unit 141.

Figure 2:
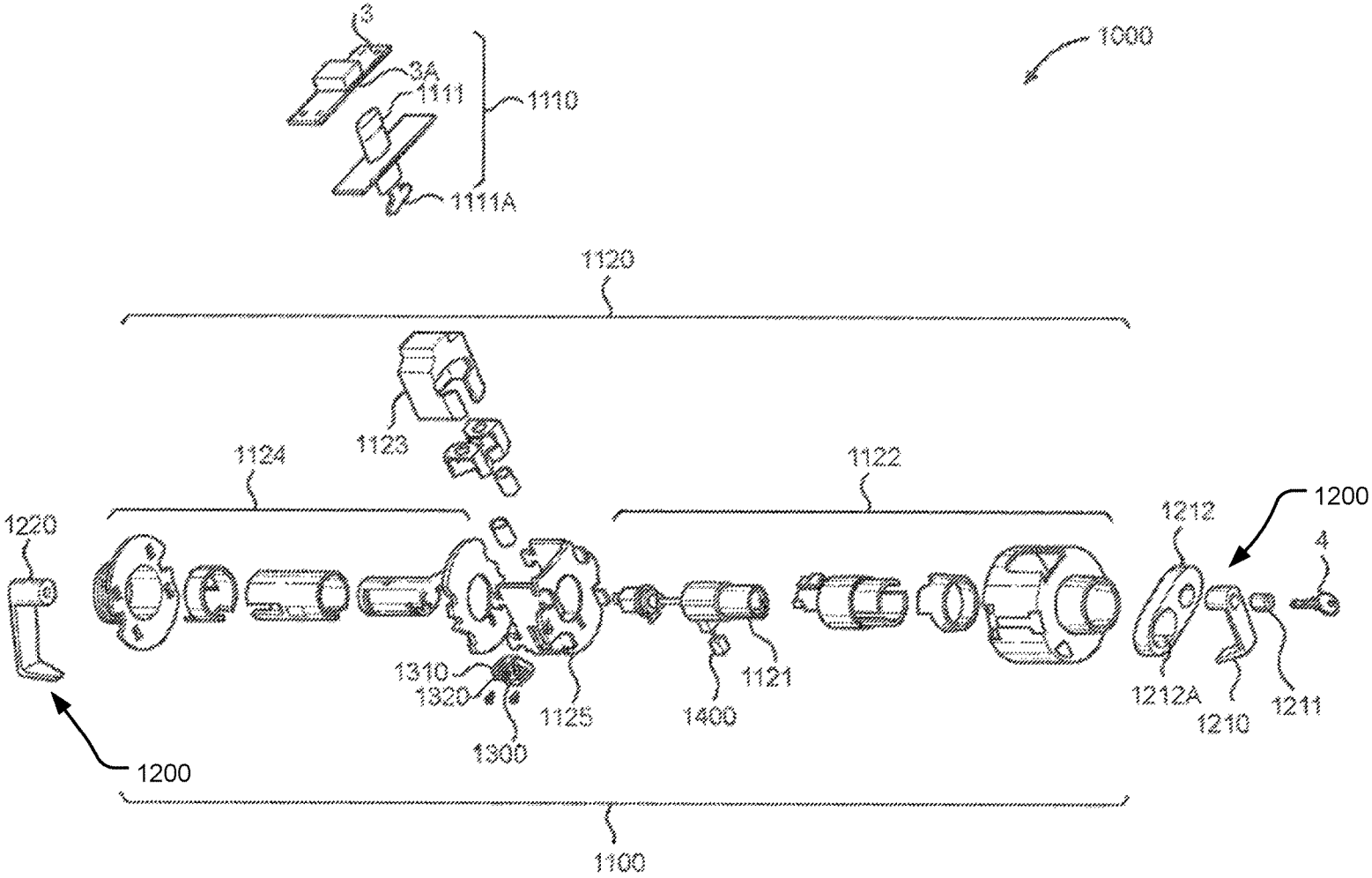
FIG. 2 illustrates an exploded view of a lockset, according to an exemplary embodiment of the present general inventive concept.

FIG. 2 illustrates an exploded view of a lockset 1000, according to an exemplary embodiment of the present general inventive concept.

Referring to FIG. 2, the lockset 1000 may include a lock 1100, at least one handle 1200, a sensor 1300, and a printed circuit board (PCB) 1400, but is not limited thereto. The lockset 1000 may be installed upon a door that may open and close with respect to a doorframe.

The lock 1100 may include a latch assembly 1110 and a lock assembly 1120.

The latch assembly 1110 may include a latch bolt 1111 to come in contact with a strike plate 3 disposed within the doorframe. More specifically, the latch bolt 1111 may be disposed at least partially within an aperture 3*a* of the strike plate 3 when the door upon which the lock 1100 is installed is closed.

The lock assembly 1120 may be a part of the latch assembly 1110, or may be separate from the latch assembly 1110 to provide additional door-locking features, and may include at least one of a knob lock, a lever handle lock, a deadbolt lock, a mortise lock, and keyless entry lock, but is not limited thereto. The lock may be unlocked by an electronic key, such as a key card, chip card, fob, etc., or may alternatively be unlocked by a regular, non-electronic, key. Furthermore, other mechanisms may be used to lock and/or unlock the lock 1100, such as mobile devices, keypads, touch plates, cameras, and other types of wireless communication objects and/or devices.

The present general inventive concept illustrates the lockset 1000 as a combination of a keyless entry lock and keyed entry lock, which combines the lock 1100 and the handle 1200 within a single lockset 1000 that allows a user to use a physical non-electronic key to open the lock 1100, or alternatively, to use a wireless key entry system such as a proximity-based unlocking mechanism (such as a key fob).

The lock assembly 1120 may include a motor 1121, an outside handle connected assembly 1122, a latch-connected mechanism 1123, an inside handle connected assembly 1124, and a lock chassis 1125.

The motor 1121 may be connected within the lock 1100 to control a locking and/or unlocking of either one of the latch bolt 1111 and the lock assembly 1120.

The motor 1121 may also be connected to and controlled by the PCB 1400. More specifically, the PCB 1400 may determine that an authorized user has brought a key fob, for example within a certain proximity of a key fob reader of the lock 1100, and may send a signal to the motor 1121 to unlock either one of the latch bolt 1111 and the lock assembly 1120.

The motor 1121 may be part of a motor assembly and can be connected within the lock 1100 to unlock the lock 1100 electronically, and may be connected within the lock 1100 and/or to the latch-connected mechanism 1123 wirelessly or with cables. Also, a motor chassis cover may be included to house a cylindrical housing of the motor 1121.

The handle 1200 may include an outside handle 1210 and an inside handle 1220.

More specifically, the outside handle 1210 may be disposed on an outside area or surface of the door on which the lockset 1000 is mounted, while the inside handle 1220 may be disposed on an inside area of the door. As such, in order to open the door using the outside handle 1210, the user may be required to use a physical non-electronic key or keyless mechanism to first unlock the lock 1100 prior to the door being openable from the outside. Conversely, the user may not be required to use a physical non-electronic key or keyless mechanism to first unlock the lock 1100 prior to the door being openable using the inside handle 1220, for at least the reason that it is assumed that the user is already permitted to be inside a room or structure where the inside handle 1220 is located.

Figure 3:
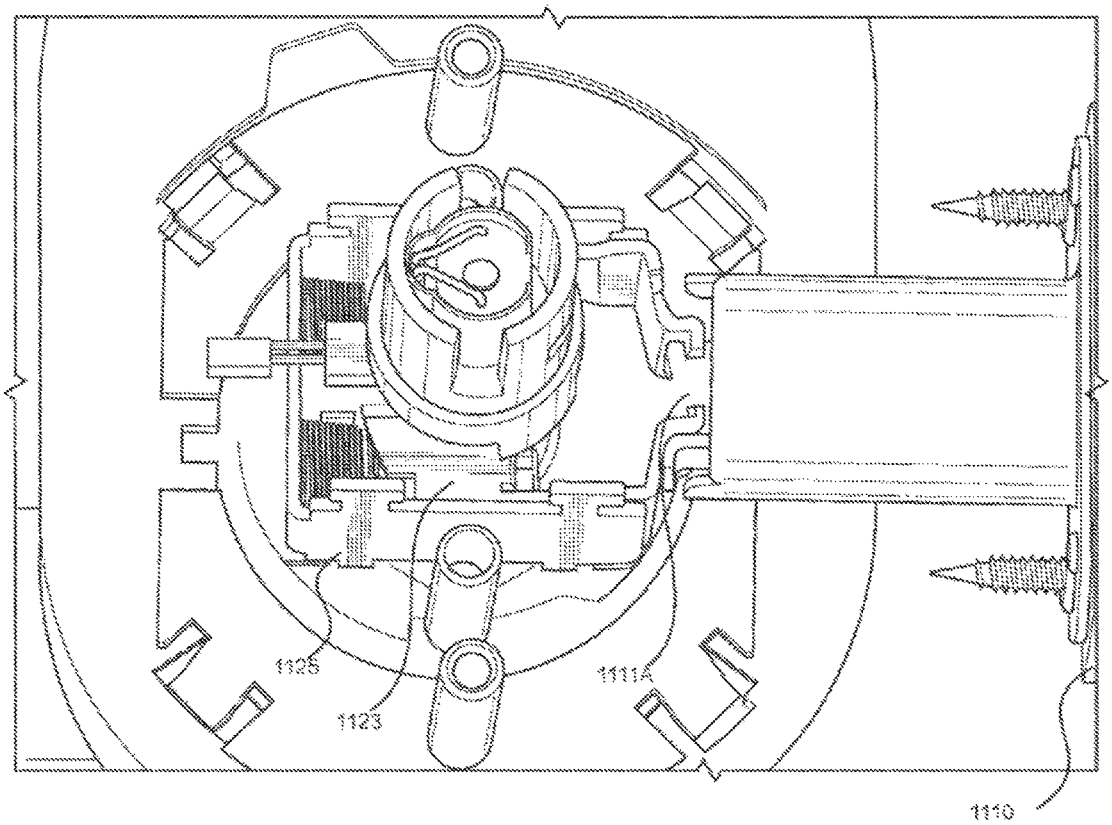
FIG. 3 illustrates a zoomed-in view of a latch-connected mechanism connected to a latch assembly, according to an exemplary embodiment of the present general inventive concept.

FIG. 3 illustrates a zoomed-in view of the latch-connected mechanism 1123 connected to the latch assembly 1110, according to an exemplary embodiment of the present general inventive concept.

Figure 4:
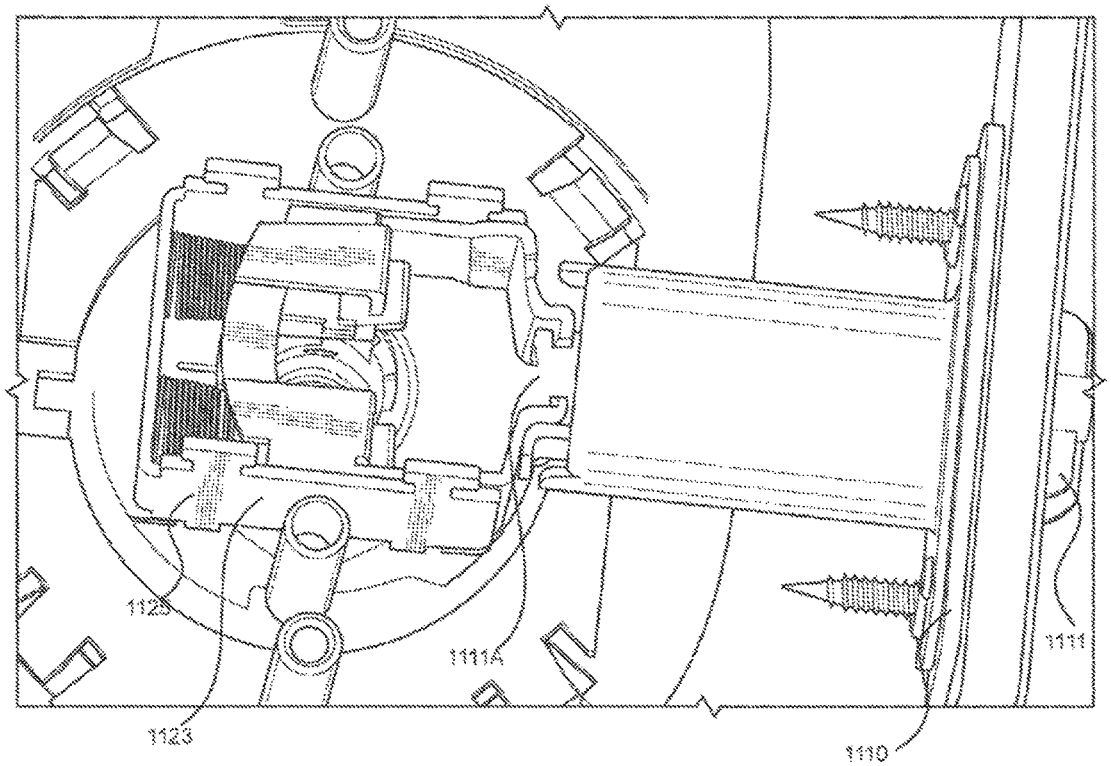
FIG. 4 illustrates another zoomed-in view of a latch-connected mechanism connected to a latch assembly, according to an exemplary embodiment of the present general inventive concept.

FIG. 4 illustrates another zoomed-in view of the latch-connected mechanism 1123 connected to the latch assembly 1110, according to an exemplary embodiment of the present general inventive concept.

Referring to FIGS. 2 through 4, the outside handle 1210 may be connected to the outside handle connected assembly 1122 which is operably connected to the latch-connected mechanism 1123, and the inside handle 1220 may be connected to the inside handle connected assembly 1124 which may not be operably connected to the latch-connected mechanism 1123.

The outside handle 1210 may include a non-electronic mechanical lock 1211 that may be opened with a key 4. The key 4 may be a mechanical (i.e., physical) non-electronic key. The outside handle 1210 may also include an electronic lock 1212 than includes sensor circuitry 1212*a* therein to detect and/or sense when a key fob or any other type of passive or active proximity device or card is brought within a certain proximity of the electronic lock 1212. The sensor circuitry 1212*a* may be connected to the PCB 1400 to control whether a user is authorized to open the door.

Figure 5:
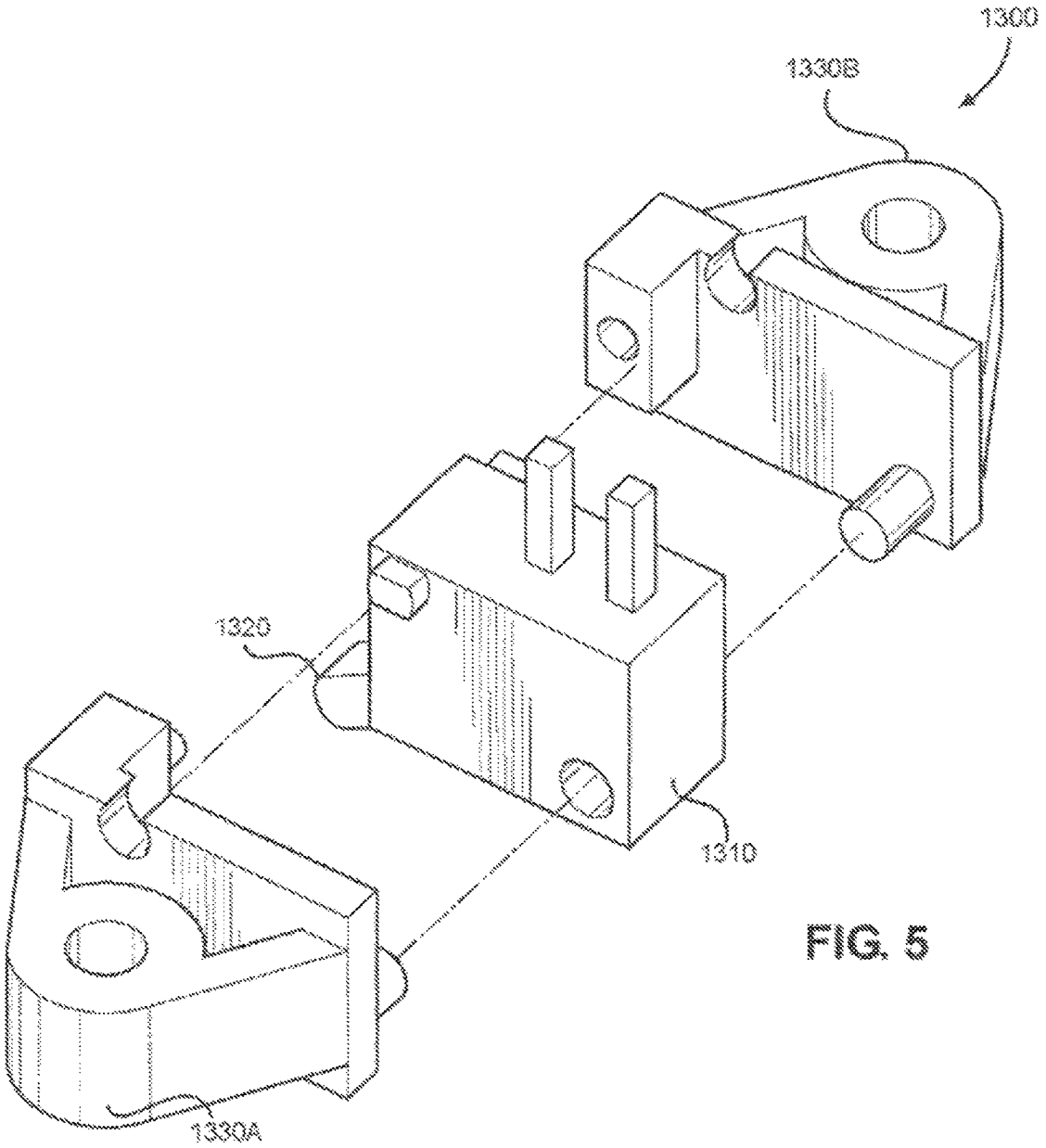
FIG. 5 illustrates a zoomed-in view of a sensor embodied as a switch and first and second switch holders, according to an exemplary embodiment of the present general inventive concept.

Referring to FIG. 2 and the zoomed-in view in FIG. 5, the sensor 1300 is illustrated as a switch having at least a portion thereof that is movable from a first position to a second position. More specifically, the sensor 1300 may include a switch body 1310, a switching portion 1320, and first and second switch holders 1330*a* and 1330*b* (FIG. 5).

Figure 6:
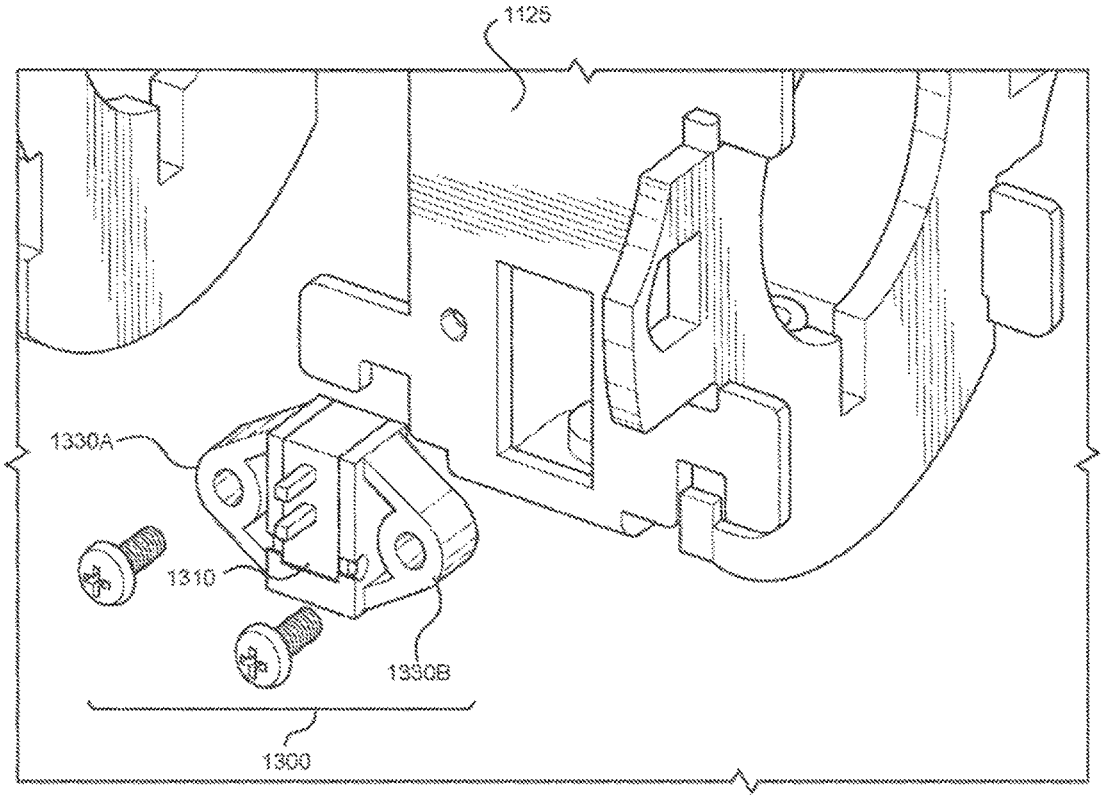
FIG. 6 illustrates a sensor embodied as a switch prior to installation on a lock chassis, according to an exemplary embodiment of the present general inventive concept.

FIG. 6 illustrates the sensor 1300 embodied as a switch prior to installation on the lock chassis 1125, according to an exemplary embodiment of the present general inventive concept.

Figure 7:
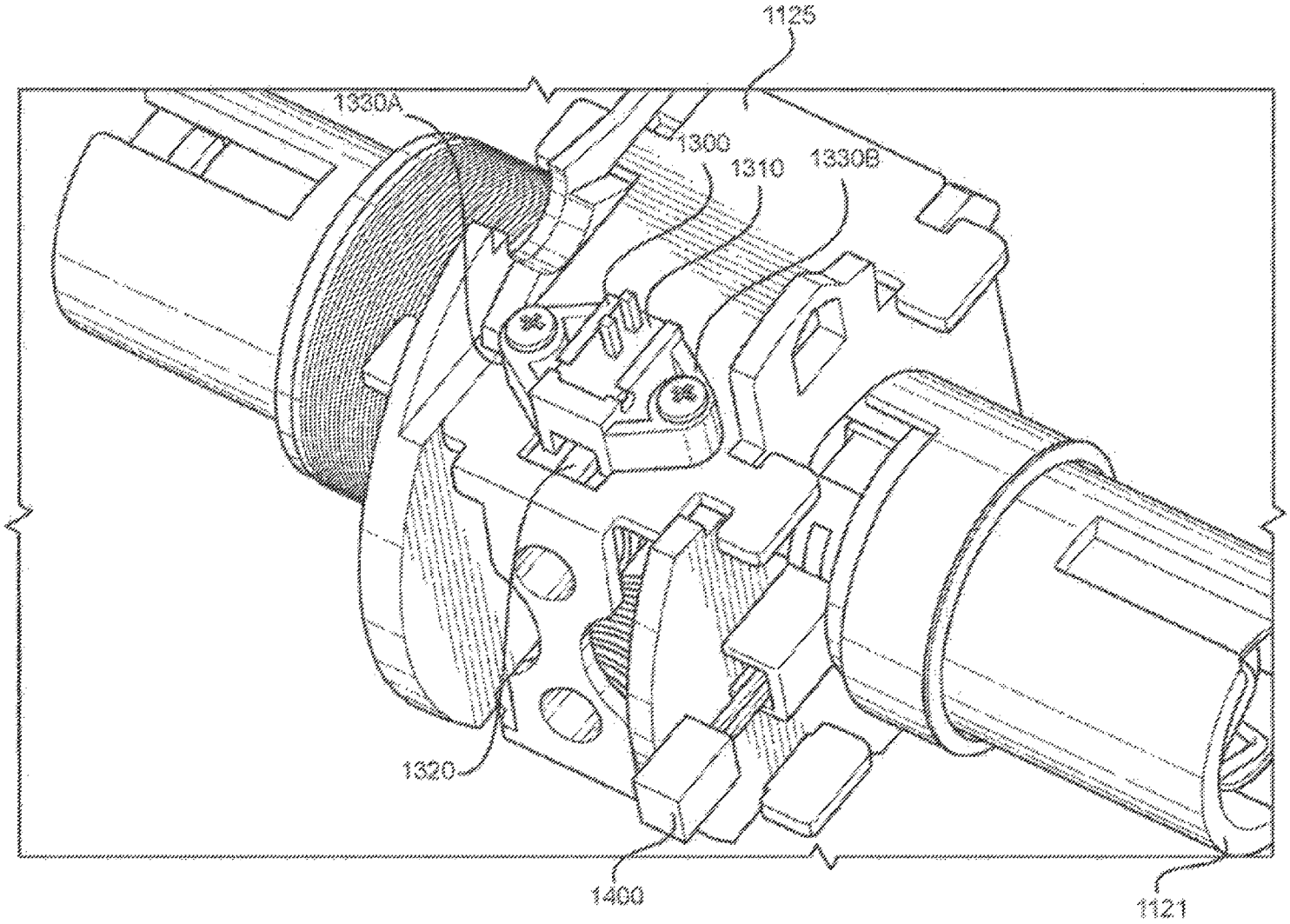
FIG. 7 illustrates a zoomed-in view of sensor embodied as a switch installed on a lock chassis, according to an exemplary embodiment of the present general inventive concept.

FIG. 7 illustrates a zoomed-in view the sensor 1300 embodied as a switch installed on the lock chassis 1125, according to an exemplary embodiment of the present general inventive concept.

Figure 8:
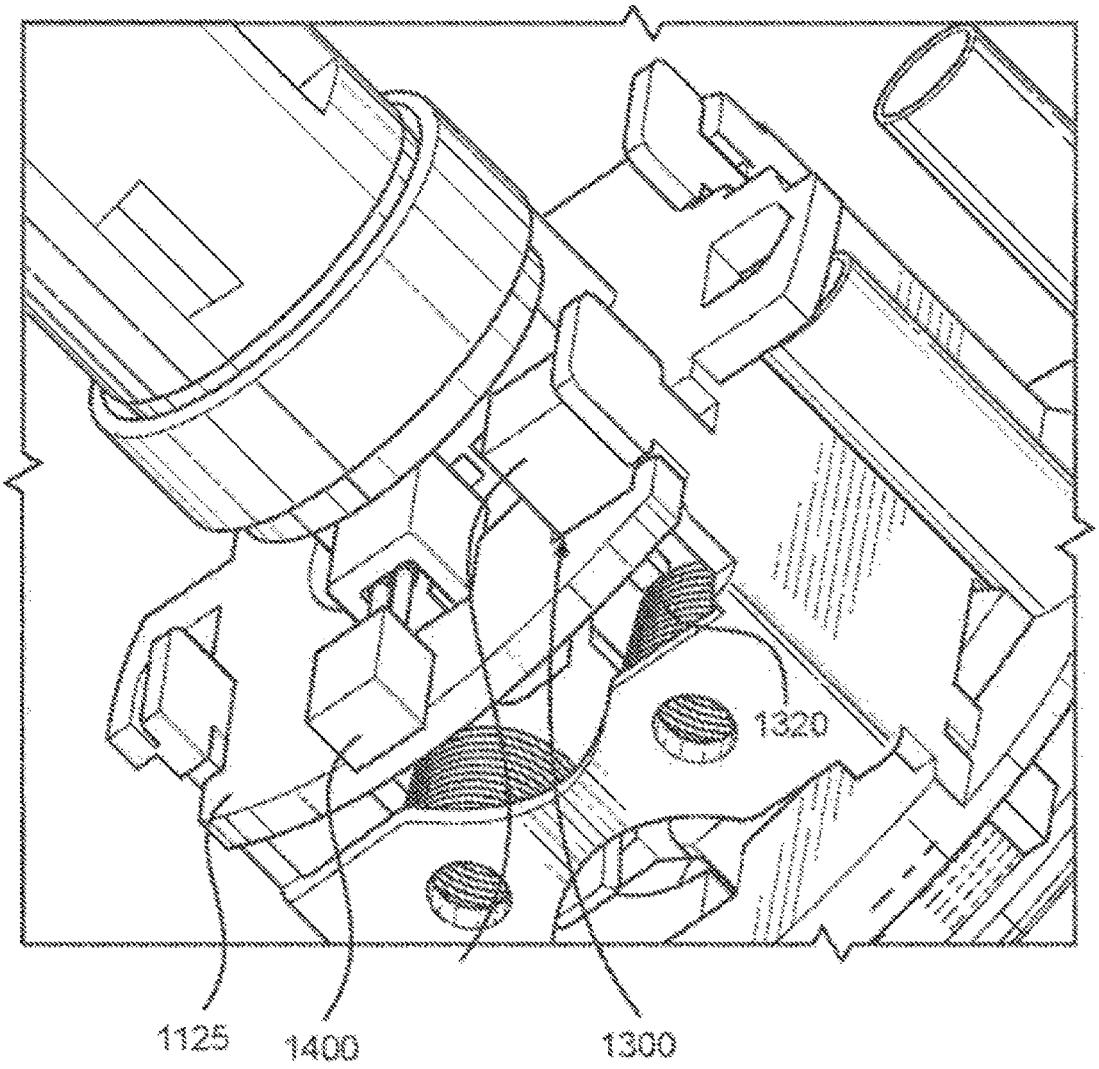
FIG. 8 illustrates another zoomed-in view of sensor embodied as a switch installed on a lock chassis, according to an exemplary embodiment of the present general inventive concept.

FIG. 8 illustrates another zoomed-in view of sensor 1300 embodied as a switch installed on the lock chassis 1125, according to an exemplary embodiment of the present general inventive concept.

Referring to FIGS. 2 and 5 through 8, the switch body 1310 of the sensor 1300 may be installed within a portion of the lock assembly 1120 to allow the latch-connected mechanism 1123 to optionally come into contact with the switching portion 1320. For example, the switch body 1310 may be connected to the switch holders 1330*a* and 1330*b*, which may be installed onto the lock chassis 1125 using screws, adhesives, or any other type of connection mechanism.

When the switching portion 1320 is moved from a first position to a second position, the PCB 1400 may interpret that a user has attempted to open the door with the key 4, instead of a keyless entry mechanism. In other words, if a user, e.g., an unauthorized user, obtains (e.g., steals) the key 4 to the lock 1100 and uses the key 4 to open the door, the switching portion 1320 may move from the first position to the second position when the outside handle 1210 is turned, thereby allowing the PCB 1400 to determine that the key 4 has been used to unlock the lock 1100.

If a user, e.g., an authorized user, uses a key fob to open the door, the switching portion 1320 may automatically be switched by the PCB 1400 to the second position without the PCB 1400 interpreting that the switch to the second position was due to an unauthorized opening of the door. In other words, if an authorized user opens the door with a key fob, then the PCB 1400 does not count the switching of the switching portion 1320.

Logic within the PCB 1400 may include various criteria to denote that the key 4 has been used to unlock the door. More specifically, the logic of the PCB 1400 could include detecting that a credential from an electronic key has not been used to unlock the lock of the door, and that the switching portion 1320 has been switched. If all of the above detections occur, then the PCB 1400 may determine that the key 4 has been used to unlock the door.

Returning to FIG. 2, the latch-connecting mechanism 1123 may be connected at a first end portion to a latch bolt connecting portion 1111*a* of the latch bolt 1111 of the latch assembly 1110, and may be connected at a second end portion to the outside handle connected assembly 1122.

In order to move the switching portion 1320 of the sensor 1300 from the first position to the second position, the outside handle 1210 may be turned by the user after the key 4 has been used to open the lock 1100. When the outside handle 1210 is turned, the latch-connecting mechanism 1123 (which is connected to the latch bolt 1111 via the latch bolt connecting portion 1111*a*) moves together with the latch bolt 1111. When the latch-connecting mechanism 1123 moves, a portion of the latch-connecting mechanism 1123 may contact the switching portion 1320, causing the switching portion 1320 to move from the first position to the second position. When the switching portion 1320 moves from the first position to the second position, the PCB 1400 interprets the movement of the switching portion 1320 from the first position to the second position as an instance where the key 4 was used to open the lock 1100.

A storage unit within the PCB 1400 (e.g., storage unit 141 of PCB 140 of FIG. 1) may record an occurrence and a time of the switching of the switching portion 1320 from the first position to the second position. The switching portion 1320 may be triggered multiple times, and the PCB 1400 may record each separate occurrence of the triggering of the switch.

Figure 9:
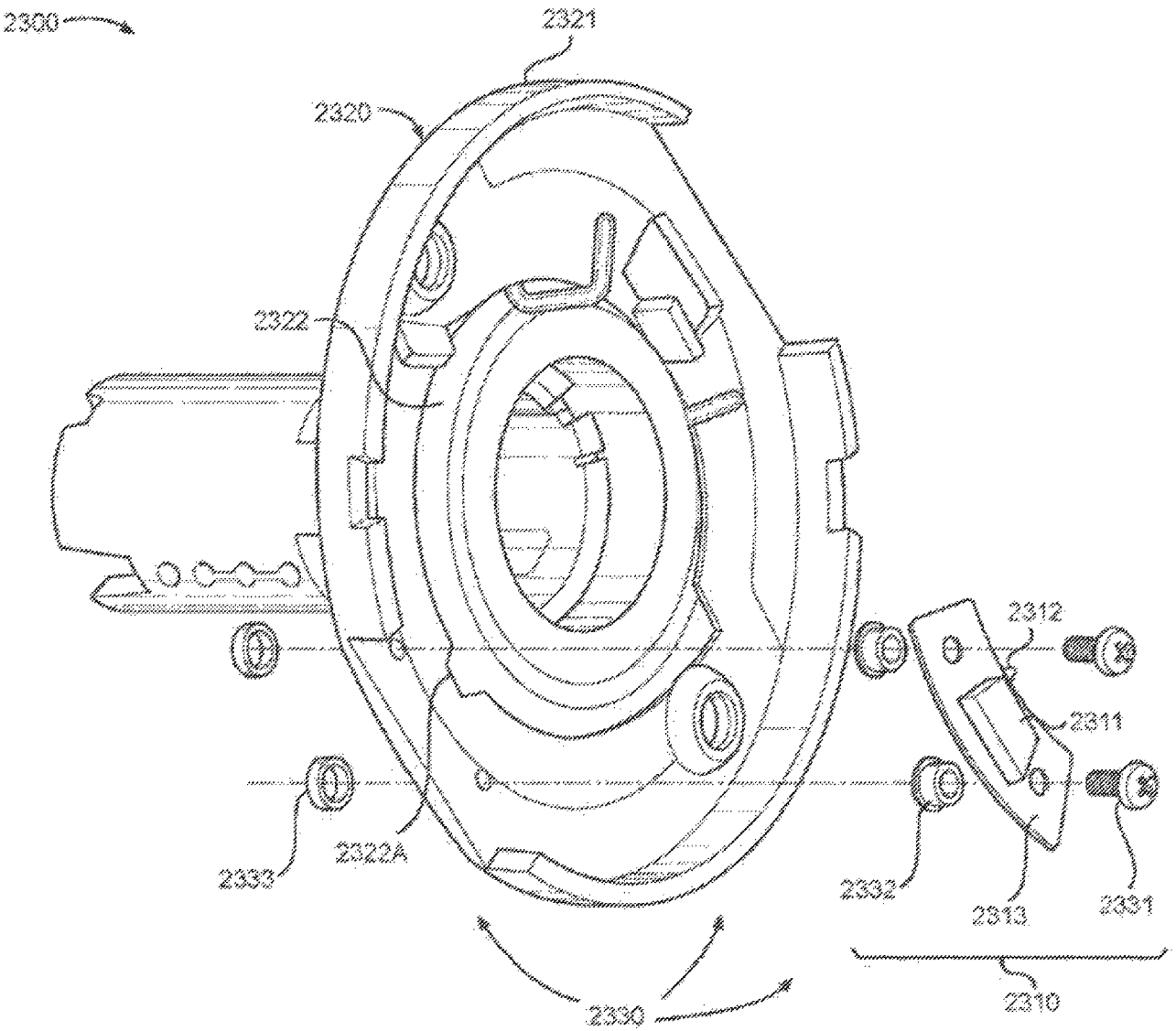
FIG. 9 illustrates a zoomed-in view of an internal handle monitoring switch assembly, according to an exemplary embodiment of the present general inventive concept.

FIG. 9 illustrates a zoomed-in view of an internal handle monitoring switch assembly 2300, according to an exemplary embodiment of the present general inventive concept.

The internal handle monitoring switch assembly 2300 may include a handle switch assembly 2310, an internal handle chassis 2320, and a plurality of connectors 2330.

The handle switch assembly 2310 may include a handle switch body 2311, a handle switch switching portion 2312, and a handle switch installation portion 2313.

The internal handle chassis 2320 may include a chassis body 2321 and a rotating portion 2322.

The plurality of connectors 2330 may include at least one screw 2331, at least one extending nut 2332, and at least one connecting nut 2333.

Figure 10:
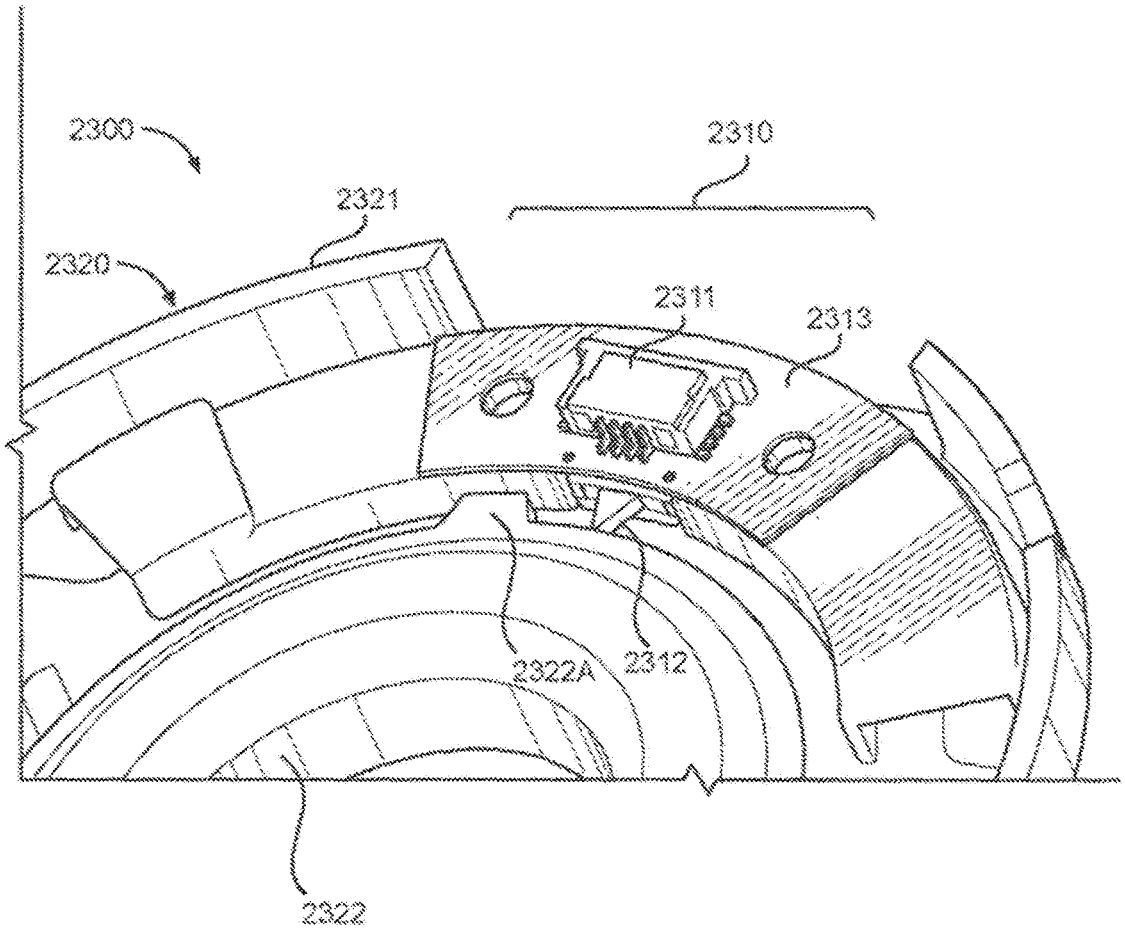
FIG. 10 illustrates another perspective of a zoomed-in view of an internal handle monitoring switch, according to an exemplary embodiment of the present general inventive concept.

FIG. 10 illustrates another perspective of a zoomed-in view of the internal handle monitoring switch assembly 2300, according to an exemplary embodiment of the present general inventive concept.

Referring to FIGS. 9 and 10, in order to install the handle switch assembly 2310 onto the internal handle chassis 2320, the at least one screw 2331 may be inserted into at least one aperture of the handle switch body 2311. Next, the at least one extending nut 2332 may be disposed between the handle switch installation portion 2313 and a first surface of the chassis body 2321, such that the at least one screw 2331 extends through the at least one extending nut 2332 and though apertures of the chassis body 2321. Finally, to complete installation, the at least one connecting nut 2333 may screw onto an end of the at least one screw 2331 at a second surface of the chassis body 2321.

The internal handle monitoring switch assembly 2300 of FIGS. 9 and 10 may be used to monitor whether the inside handle 1220 of FIG. 2 has been turned. More specifically, when the inside handle 1220 is turned, the rotating portion 2322 correspondingly rotates, and a switch contact portion 2322*a* of the rotating portion 2322 may contact the handle switch switching portion 2312 such that the handle switch switching portion 2312 moves from a first position to a second position. As a result of the handle switch switching portion 2312 moving from the first position to the second position, additional logic within the PCB 1400 (FIG. 2) may further determine whether the key 4 has been used to unlock the door. More specifically, the logic of the PCB 1400 could include detecting that a credential from an electronic key has not been used to unlock the lock 1100 of the door, that the switching portion 1320 has been switched (i.e., moved from the first position to the second position), and that the handle switch switching portion 2312 of the inside handle 1220 has not been switched. If all of the above detections occur, then the PCB can determine that the key 4 has been used to unlock the door. Although FIGS. 9 and 10 are directed to the internal handle monitoring switch assembly 2300 for the internal handle 1220 of FIG. 2, the same mechanisms described herein may be applied to the outside handle 1210 of FIG. 2.

Figure 11A:
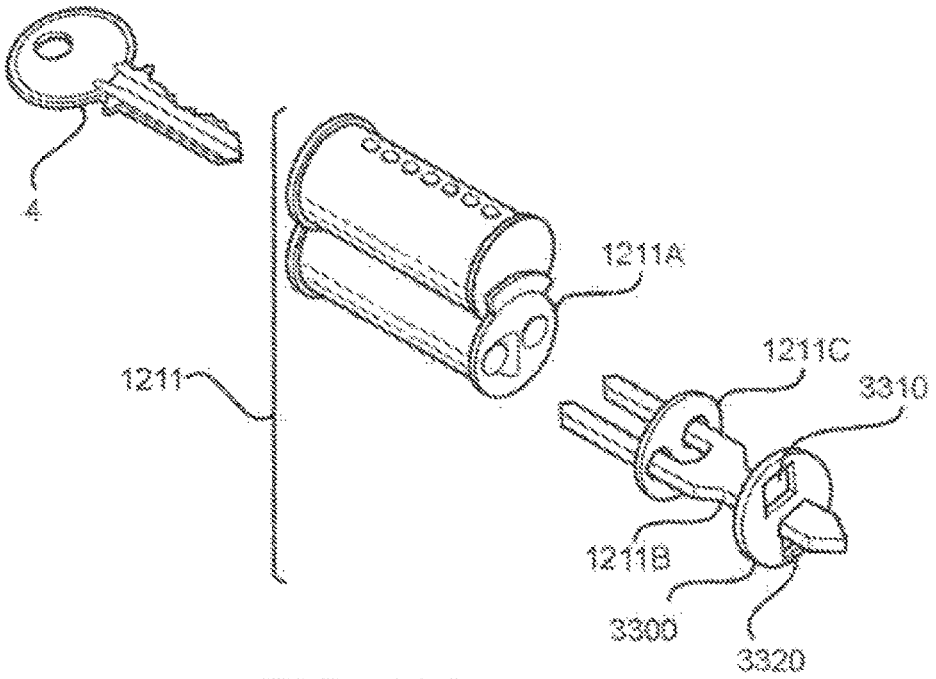
FIG. 11A illustrates a non-electronic mechanical lock including an accelerometer assembly used as a tilt sensor in a lockset, according to an exemplary embodiment of the present general inventive concept.

FIG. 11A illustrates a non-electronic mechanical lock 1211 including an accelerometer assembly 3300 used as a tilt sensor in a lockset 1000, according to an exemplary embodiment of the present general inventive concept.

Referring to FIG. 11A, the non-electronic mechanical lock 1211 may include a core 1211*a*, a throw member 1211*b*, and a blocking plate 1211*c*. The core 1211*a* may receive the key 4 at a first end, and at least a portion of the throw member 1211*b* at a second end. The blocking plate 1211*c* may prevent unauthorized access to the non-electronic mechanical lock 1211. When the key 4 is inserted within the core 1211*a* and is turned, the throw member 1211*b* may also correspondingly turn.

Figure 11B:
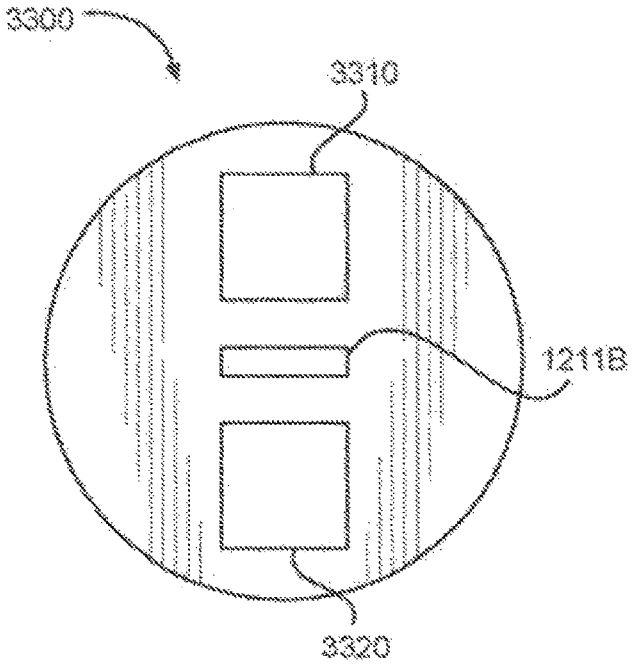
FIG. 11B illustrates a zoomed-in front view of an accelerometer assembly used as a tilt sensor in a lockset, according to an exemplary embodiment of the present general inventive concept.

FIG. 11B illustrates a zoomed-in front view of an accelerometer assembly 3300 used as a tilt sensor in a lockset 1000, according to an exemplary embodiment of the present general inventive concept.

Referring to FIGS. 11A and 11B, the accelerometer assembly 3300 may be installed on at least a portion of the throw member 1211*b*.

The accelerometer assembly 3300 may include an accelerometer 3310 and a printed circuit board (PCB) 3320.

The accelerometer 3310 may act as a tilt sensor, and may sense whether the throw member 1211*b* within the lock has been rotated by the key 4. More specifically, when the throw member 1211*b* is rotated, the attached accelerometer assembly 3300 also rotates, causing the accelerometer 3310 to sense the rotation of the accelerometer assembly. As a result, the PCB 3320 may send a signal to the PCB 1400 of FIG. 2 that the accelerometer 3310 has been rotated. As a result, either the PCB 3320 or the PCB 1400 can determine that the lock 1100 of the door has been unlocked with a mechanical non-electronic key (i.e., the key 4), but is not limited thereto.

The present general inventive concept is directed to a key monitoring device that monitors whether a standard non-electronic key has been used to unlock a door lock. The "key monitoring" could conceivably be a device other than a key. As such, if an electronic device and/or lock fails for any reason, such as an emergency or a power outage, there is an emergency mechanical operation needed to unlock the lock so the door may be opened. Otherwise, a life-safety issue exists because physical plant personnel conceivably could not get inside the door without breaking the door down or going over the ceiling to get into the room. Although emergency mechanical key override exists, there is presently no monitoring of the mechanical operation of the door lock. As such, the present general inventive concept solves the problems of determining whether a mechanical key was used to unlock the door lock, and at what time the door was accessed.

According to an exemplary embodiment of the present general inventive concept, the key monitoring device monitors the operation of the latch to recognize/detect whether the door has been unlocked mechanically by a non-electronic key.

According to another exemplary embodiment of the present general inventive concept, the key monitoring device is directed to rotation of a throw member connected to a lock core/cylinder. More specifically, a sensor, such as an accelerometer, may be used to detect rotation of a throw member as it is rotated in response to a non-electronic key entering a cylinder and rotating a lock core within the cylinder. This detection can then be saved in a storage unit of a printed circuit board, to be later accessed by a user to determine if and/or when the lock was unlocked by a non-electronic key.

It should be noted that any combination of the above embodiments may be used to perform functions of detecting whether an electronic door lock has been opened by a non-electronic key.

The present general inventive concept may include a system to detect whether a non-electronic key has been used to open an electronic lock. More specifically, the system may include an electronic lock, an access control system, a mobile device, a non-electronic key, and a card key. The access control system may communicate with the electronic lock via WI FI, BLUETOOTH, or any other type of wireless or wired communication system or method. Therefore, a user may use a mobile device or the card key to unlock and/or lock the electronic lock when it is online, so that credentials may be verified by the access control system prior to the unlocking and/or locking. An administrator with proper permissions may access the access control system to verify which type of key has accessed the lock in the door. Also, when the electronic lock is offline, the non-electronic key may be used to unlock the electronic lock, and the mobile device may be used to communicate with the electronic lock (via BLUETOOTH, RFID, or any other type of near field communication method) to determine whether the electronic lock has been accessed by the non-electronic key. Also, when the system is back online, the access control system may be used to verify whether the electronic lock has been accessed by the non-electronic key.

The present general inventive concept may include a method of detecting whether a non-electronic key has been used to open an electronic lock. The method may include detecting whether a key has been used to turn a throw member of the electronic lock, detecting whether an inner door handle has been turned, detecting whether a credential has been used to open the electronic lock, and/or detecting whether a latch of the electronic lock has been moved. The method may further include determining that the non-electronic key has been used to open the electronic lock if any one or combination of the above detections has occurred, and informing a user that the non-electronic key has been used to open the electronic lock based on the determination.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An electronic lockset configured to be mounted on a door, the electronic lockset comprising:

a lock to prevent the door from opening when the lock is in a locked state, the lock unlockable to an unlocked state by an electronic key and by a non-electronic key, individually;

a handle to open the door when the lock is in an unlocked state;

a sensor operably connected to the lock to sense whether the lock is switched from the locked state to the unlocked state; and a printed circuit board (PCB) operably connected to the sensor, the PCB comprising logic executable by a processor and a storage unit to store information sensed by the sensor, the logic configured to distinguish whether the electronic key or the non-electronic key was used to switch the lock from the locked state to the unlocked state.

2. The electronic lockset of claim 1, wherein the lock comprises:

an outside handle connected assembly connected to the handle;

a latch bolt to be at least partially disposed within a door strike when the door is shut;

a latch-connecting mechanism connected at a first end to the latch bolt and connected at a second end to at least a portion of the outside handle connected assembly, to move from a first position to a second position in response to a turning of the handle.

3. The electronic lockset of claim 2, wherein the sensor comprises a switch including a switching portion to move from a first switch position to a second switch position in response to the latch-connecting mechanism contacting and pushing the switching portion during movement of the latch-connecting mechanism from the first position to the second position.

4. The electronic lockset of claim 3, wherein the sensor detects that the switching portion has moved from the first switch position to the second switch position and the PCB interprets the movement of the switching portion as an indication that the non-electronic key has opened the lock.

5. The electronic lockset of claim 1, further comprising:

a rotating portion to rotate simultaneously with a rotation of the handle, the rotating portion comprising a switch contact portion to rotate together with the rotating portion, wherein the sensor comprises a handle switch switching portion to move from a first handle switch position to a second handle switch position in response to the switch contact portion of the rotating portion contacting and pushing the handle switch switching portion.

6. The electronic lockset of claim 5, wherein the sensor detects that the handle switch switching portion has moved from the first handle switch position to the second handle switch position and the PCB interprets the movement of the handle switch switching portion as an indication that the non-electronic key has opened the lock.

7. The electronic lockset of claim 1, wherein the lock comprises:

a cylinder to receive the non-electronic key therein; and a throw member to rotate along with and in response to a rotation of the non-electronic key within the cylinder.

8. The electronic lockset of claim 7, wherein the sensor comprises:

an accelerometer assembly, comprising:

an accelerometer to detect whether the throw member has been rotated, and another printed circuit board to send a signal to the PCB that the accelerometer has been rotated to indicate that the non-electronic key has opened the lock.

9. The electronic lockset of claim 1, wherein the storage unit stores information that the non-electronic key was used to switch the lock from the locked state to the unlocked state.

10. An electronic lockset comprising:

a lock comprising a latch bolt moveable from a locked position to an unlocked state by an electronic key and by a non-electronic key, individually;

a handle;

a latch-connecting mechanism connected to the latch bolt and operably connected to the handle, the latch-connecting mechanism moveable from a first position to a second position in response to a turning of the handle;

a sensor comprising a switching portion to move from a first switch position to a second switch position in response to the latch-connecting mechanism contacting and pushing the switching portion during movement of the latch-connecting mechanism from the first position to the second position; and a printed circuit board (PCB) operably connected to the sensor and comprising logic executable by a processor, the PCB configured to determine that the switching portion has moved from the first switch position to the second switch position and that the electronic key was not used.

11. The electronic lockset of claim 10, further comprising:

a rotating portion to rotate simultaneously with a rotation of the handle, the rotating portion comprising a switch contact portion to rotate together with the rotating portion, and a handle sensor comprising a handle switch switching portion to move from a first handle switch position to a second handle switch position in response to the switch contact portion of the rotating portion contacting and pushing the handle switch switching portion.

12. The electronic lockset of claim 11, wherein the handle sensor detects that the handle switch switching portion has moved from the first handle switch position to the second handle switch position and the PCB interprets the movement of the handle switch switching portion as an indication that the non-electronic key has opened the lock.

13. The electronic lockset of claim 11, wherein the handle is an interior handle, and the lockset further comprises an exterior handle.

14. The electronic lockset of claim 11, wherein the PCB further comprises a storage unit to store information that the switching portion has moved from the first switch position to the second switch position and that the electronic key was not used.

15. An electronic lockset comprising:

a lock comprising a latch bolt moveable from a locked position to an unlocked state by an electronic key and by a non-electronic key individually;

the lock further comprising a cylinder to receive the non-electronic key therein, the cylinder operably connected to a throw member to rotate along with and in response to a rotation of the non-electronic key within the cylinder to move the latch bolt; and an accelerometer operably connected to the throw member to detect whether the throw member has been rotated.

16. The electronic lockset of claim 15, further comprising a printed circuit board (PCB) operably connected to the accelerometer, the PCB comprising logic executable by a processor, the logic configured to determine that the accelerometer has been rotated to indicate that the non-electronic key has opened the lock.

17. The electronic lockset of claim 16, wherein the PCB further comprises a storage unit to store information that the accelerometer has been rotated to indicate that the non-electronic key has opened the lock.

* * * * *